United States Patent [19]

Cieszko et al.

[11] 3,939,901

[45] Feb. 24, 1976

[54] METHOD AND APPARATUS FOR COOLING AND DEAERATING INTERNAL COMBUSTION ENGINE COOLANT

[75] Inventors: Joseph T. Cieszko, Richmond Heights; Charles L. Moon, Brecksville, both of Ohio

[73] Assignee: White Motor Corporation, Cleveland, Ohio

[22] Filed: Apr. 19, 1973

[21] Appl. No.: 352,414

[52] U.S. Cl. ..... 165/1; 123/41.51; 123/41.54; 165/107; 165/148; 165/176

[51] Int. Cl.[2] ..... F01P 5/10

[58] Field of Search ..... 165/110, 1, 111, 51, 176, 165/148, 150; 123/41.54, 41.51

[56] References Cited

UNITED STATES PATENTS

| | | | |
|---|---|---|---|
| 2,264,820 | 12/1941 | Young | 165/150 X |
| 2,343,145 | 2/1944 | Heiney | 165/111 X |
| 3,077,927 | 2/1963 | White et al. | 123/41.54 X |
| 3,132,690 | 5/1964 | Suchomel | 165/110 |
| 3,254,707 | 6/1966 | Ferguson | 165/110 |
| 3,275,070 | 9/1966 | Beatenbough et al. | 123/41.54 X |
| 3,455,377 | 7/1969 | Hayes | 123/41.54 X |

FOREIGN PATENTS OR APPLICATIONS

| | | | |
|---|---|---|---|
| 1,125,233 | 3/1962 | Germany | 123/41.51 |

OTHER PUBLICATIONS

Kreith, F., *Principles of Heat Transfer*, 6/1961, International Textbook Co., Scranton, Pa., pp. 333 to 337.

*Primary Examiner*—Albert W. Davis, Jr.
*Attorney, Agent, or Firm*—Watts, Hoffmann, Fisher & Heinke Co.

[57] ABSTRACT

An internal combustion engine cooling system is disclosed which utilizes a coolant having a greater viscosity and film strength than water. Heat is transferred from the coolant as it flows through a radiator assembly. The coolant is directed through multiple heat transfer passes defined by core tubes and headers of the radiator with the coolant moving through the core tubes of each pass at a flow velocity which insures a Reynolds number of no less than 5000. The flow velocity is substantially reduced in a header communicating the core tubes of successive heat transfer passes so that a region of substantially quiescent coolant is produced in the header. Air or gas in the coolant is collected and expelled from the header adjacent the quiescent coolant region.

8 Claims, 6 Drawing Figures

METHOD AND APPARATUS FOR COOLING AND DEAERATING INTERNAL COMBUSTION ENGINE COOLANT

BACKGROUND OF THE INVENTION

1. Field of the Invention

The present invention relates to an internal combustion engine coolant system and more particularly relates to a method and apparatus for transferring heat from and degassing liquid coolant used in such a system.

2. The Prior Art

Internal combustion engine liquid cooling systems have traditionally employed a pump driven by the engine which circulated a liquid coolant through coolant passages in the engine and then through a radiator by which heat was transferred from the coolant to atmospheric air.

The radiators of these coolant systems have generally comprised manifold-like tanks disposed at opposite ends of core tubes. The coolant has been directed to one tank from the engine and thence through the core tubes to the other tank from which the coolant is returned to the engine by the pump. Atmospheric air forced across the core tubes cooled the coolant.

The use of multipass radiators was proposed in some early coolant systems. In these proposed radiators, the coolant traversed the core tubes two or more times before being returned to the engine. These proposed radiators were relatively bulky and complex. Furthermore, continuing improvements in materials generally and in engine and radiator designs over the years resulted in higher engine operating temperatures, pressurized high temperature coolant systems, and more efficient coolant heat rejection. As a result, relatively simple, compact single pass radiators have become standard for use with automotive I.C. engines.

Water has long been the usual coolant for liquid cooled internal combustion engines because of its availability and favorable heat transfer characteristics and the design of engine coolant systems has generally presupposed the use of water as the coolant. In winter, or in arctic locations, antifreeze additives were normally employed to prevent freezing of the water in the systems. These additives were known to alter the heat transfer characteristics of the coolant and reduce the ability of the coolant to reject heat in the radiator, but the normally low temperature of the ambient air compensated for the changes in heat transfer characteristics so that the effectiveness of the coolant system designs was largely unaffected by the use of coolant additives in cold seasons or climates.

Ethylene glycol has been used as a coolant system antifreeze additive for many years. In the past this substance was produced primarily as a coolant additive and therefore was not available in great quantities. Accordingly, ethylene glycol was expensive and its use was substantially limited to seasonal antifreeze protection. Ethylene glycol is now produced as a byproduct of certain processes for making plastics and consequently in recent years the availability of this material has increased markedly while its price has been significantly reduced.

Ethylene glycol has a number of properties which make its permanent use in coolant systems desirable. Engine coolants consisting of a mixture of ethylene glycol and water exhibit a higher boiling temperature than water, retard corrosion in the coolant systems and, as noted, protect the system against freezing particularly due to unpredicted changes in atmospheric air temperature. Accordingly, due to the noted advantages and to the relatively low price of ethylene glycol, coolants composed of ethylene gylcol and water have been increasingly used year around in many types and kinds of vehicles.

On the other hand, the specific heat or heat capacity of ethylene glycol-water coolants is less than that of water which restricts the ability of ethylene glycol-water coolants to carry heat away from the engine. Furthermore the film strength of ethylene glycol-water coolants is large when compared to that of water and this characteristic reduces the susceptibility of ethylene glycol-water coolants to deaeration. Consequently, air or gas tends to remain entrained in these coolants which has the effect of reducing their heat transfer capabilities. Year around use of this coolant has thus resulted in reductions in efficiency of the engine coolant systems, particularly in hot weather or warm climates, and as a consequence coolant system capacities have had to be increased. As engine power ratings have been increased over the years the amount of heat required to be dissipated by the radiators has likewise increased. The noted use of ethylene glycol-water coolants has also required that the radiators be modified to increase their abilities to transfer heat from the coolant.

It is well established that the heat transfer characteristics of a given radiator can be increased by increasing the area of the radiator core tubes through which heat is transferred from the engine coolant to atmospheric air. As a result, to increase coolant system capacity the heat transfer areas of the radiators have been increased by increasing the number and/or length of the core tubes. This practice has increased the size and weight of the radiators. Furthermore, the increases in size of the radiators has been disproportionately great when compared to the actual increases in cooling system capacities realized from the larger radiators.

In the passenger car industry, radiator size requirements have tended to conflict with styling considerations and in some circumstances where the conflicting interests of styling and cooling system effectiveness have been compromised, coolant system capacities have been barely adequate. In the trucking industry, the increased radiator sizes have resulted in increased cost, weight and size of tractors and truck cabs.

Heat transfer from the radiators is, as noted above, adversely affected by the presence of entrained gas or air in the coolant. Air is normally entrapped in cooling systems when the systems are filled with coolant. When the engine is operated, this air is entrained in the coolant. Air is also dissolved in the coolants, and when the engine reaches operating temperature the solubility of the air in the coolant is reduced and air comes out of solution resulting in entrained air bubbles in the coolant.

Combustion gases entrained in the coolants are perhaps more common and more troublesome than entrained air. Nearly every engine, particularly after it has been in service for a time, develops combustion gas leaks between the combustion chambers and the engine coolant passages. These leaks are normally such that small quantities of high pressure gases from a combustion chamber will flow into the coolant but the coolant will not normally flow into the combustion chamber because of its low pressure. Accordingly, in most engines combustion gases will flow into the coolant while the engine is operating, become entrained in the coolant, and reduce its heat transfer effectiveness.

Because ethylene glycol-water coolants are characterized by relatively high film strength when compared to water, entrained gas or air is not readily removable from the coolants. In conventional radiator constructions the facilities for deaerating or degassing the coolant in the radiators have not been reliable particularly when ethylene glycol-water coolants are employed. The prior art radiators provided with coolant deaeration constructions have, in the main, presupposed the use of water as an engine coolant. Since the heat transfer properties of water are generally quite favorable, the presence of some entrained air in the water has not been a cause for great concern and deaeration of coolant in radiators has been largely a hit-or-miss proposition. The use of ethylene glycol-water mixtures with their attendent less favorable heat transfer properties and high film strength has increased the need for thorough deaeration while rendering the prior art deaeration techniques even less effective.

SUMMARY OF THE INVENTION

The present invention provides a new and improved method and apparatus for increasing the heat transfer capabilities of engine coolant system utilizing ethylene glycol-water mixtures while assuring effective degassing or deaeration of the coolant passing through the radiator.

It has been discovered that the practice of increasing the number of radiator core tubes, or otherwise increasing the heat transfer areas of the radiators such as by lengthening the tubes, has had retrogressive effects on the efficiency of engine coolant systems although cooling capacities have been increased by such practices. Put another way, the increase in required radiator size has been disproportionately large as compared to the resulting increase in radiator heat transfer effectiveness.

It has been found that the kinematic viscosity of a coolant composed of one-half ethylene glycol and one-half water, by volume, is roughly three times that of water at engine operating temperatures, e.g. about 200F°. This difference in viscosity results in significantly different Reynolds numbers when the respective coolants flow through a radiator core tube at the same velocity, with the Reynolds number of the ethylene gylcol-water mixture being relatively low compared to that of the water. The Reynolds number of such a coolant is frequently below 2100 resulting in the coolant passing through the core tubes exhibiting laminar flow characteristics.

The heat transferred to or from a cylindrical tube is generally proportional to an exponential power of the Reynolds number of the fluid flowing through the tube. Moreover, the magnitude of the exponent is larger when Reynolds numbers are high, and coolant flow is turbulent, than when the Reynolds number is below 2100 and flow is laminar.

The range of Reynolds numbers from about 2100 to 10,000 is a transitional range from laminar to turbulent flow and heat transfer characteristics of the fluid are generally thought of as indeterminant. However, when Reynolds numbers are 5000 or greater, the flow through radiator core tubes has been found to be sufficiently turbulent to assure favorable overall heat transfer coefficients for the radiators when compared to the heat transfer coefficients of the same radiator with coolant flows establishing Reynolds numbers substantially less than 5000.

It has been found that if the heat rejecting ability of a given radiator through which coolant passes in the laminar flow range is inadequate, very little improvement in heat transfer is realized by lengthening the core tubes. If the number of core tubes is increased, the coolant flow area is increased and the coolant flow velocity is reduced with the result that the Reynolds number is further reduced. This reduces the amount of heat transfer from a given core tube.

Experimentation has revealed that significantly improved heat transfer is obtained by passing the ethylene glycol-water coolant through core tubes at velocities which insure turbulent flow of the coolant in the core tubes. In particular, high heat transfer rates have been obtained when flow through the core tubes produces Reynolds numbers of 5000 or more. The differences in heat transfer are sufficiently great that the size of many automotive radiators can actually be reduced without reducing the amount of heat which the radiator is capable of transferring from the coolant and without altering any remaining components of the cooling system such as the coolant pump.

The achievement of a coolant velocity through a standard size radiator core tube, i.e. a tube having a hydraulic radius of one-fourth or three-eighths inches to achieve the desired minimum Reynolds number of 5000 can be determined in terms of gallons per minute per tube. The number of core tubes required to reject the desired amount of heat from the coolant can then be determined empirically.

In a preferred embodiment of the invention an engine is provided with a multipass radiator in which the Reynolds number of the coolant flowing through the radiator core tubes is 5000 or more in the normal operating speed range of the engine to assure substantially turbulent flow of the coolant in the core tubes and thus provide efficient heat transfer from the coolant without substantially affecting the capacity requirements of the system coolant pump. The new radiator also maximizes heat transfer from coolant passing through the radiator core tubes by positively degassing the coolant.

In one preferred embodiment of the invention a vertical two-pass radiator is provided having radiator inlet and outlet openings in a bottom tank. The bottom tank is partitioned to provide separate header chambers. First and second groups of core tubes extend from the respective bottom tank header chambers to a top tank.

The top tank defines a coolant reservoir, a head space above the coolant level for gas collection and a partition or baffle plate which defines a header chamber into which all of the core tubes open. The header chamber is constructed and arranged so that coolant directed into the header chamber from the first group of core tubes is decelerated and exhibits laminar flow characteristics as it flows toward the second group of header tubes. The coolant is fractioned off from the chamber by the core tubes of the second tube group and as the coolant passes through the tubes of the second tube group it is accelerated to produce Reynolds numbers of no less than 5000.

The baffle plate defines an enlarged header chamber portion adjacent the second group of core tubes having a cross sectional area which is sufficiently large that the coolant in this portion of the header chamber is substantially quiescent. This construction therefore enables entrained gas or air to rise through the quiescent coolant to the top of the enlarged chamber portion. A vent tube communicates the enlarged chamber portion with the head space in the top tank reservoir so that detrained gas or air is exhausted from the enlarged chamber portion.

The enlarged chamber portion also functions to facilitate filling of the system when another vent tube is connected between the chamber portion and an elevated location in the coolant system at which air in the system would otherwise be trapped during filling. This air flows to the reservoir head space from the chamber.

In a preferred construction, a static pressure line extends between the top tank reservoir and the inlet of the cooling pump. The static line functions to minimize coolant pump cavitation by assuring a positive coolant pressure at the pump inlet, particularly when the engine is operating at high speed and coolant temperatures are high. The static line also functions to provide pressure communication between the top tank reservoir and the pump inlet so that gas or air detrained from the coolant is positively expelled from the header chamber portion into the coolant reservoir head space during filling.

In another preferred embodiment of the invention, the radiator is constructed with horizontal core tubes and vertically extending side tanks. The radiator outlet and inlet openings are located in the upper and lower portions, respectively, of a first partitioned side tank. The opposite side tank defines the coolant reservoir and head space and includes a deaerating baffle plate which defines a header chamber for communicating the core tube groups. The baffle plate defines an enlarged header chamber portion adjacent its upper end for providing a region of substantially quiescent coolant from which gas or air detrained from the coolant is communicated to the reservoir head space.

The horizontal tube version of the radiator may also include a static pressure line extending from the reservoir to the coolant pump inlet for enabling positive deaeration of the header chamber portion and other functions mentioned above.

A principal object of the present invention is the provision of a new and improved method and apparatus for transferring heat from an engine coolant comprising an ehtylene glycol-water mixture wherein the coolant flows through a radiator at Reynolds numbers of no less than 5000 in the normal operating speed range of the engine so that heat transfer effectiveness of the radiator is maximized.

Another object of the invention is the provision of a new and improved method and apparatus for transferring heat from an engine coolant wherein the coolant is directed through a radiator at high flow velocities and wherein the coolant in the radiator is positively deaerated.

Other objects and advantages of the invention will become apparent from the following detailed description of preferred embodiments made with reference to the accompanying drawings which form a part of the specification.

DETAILED DESCRIPTION OF THE PREFERRED EMBODIMENTS

Figure 1:
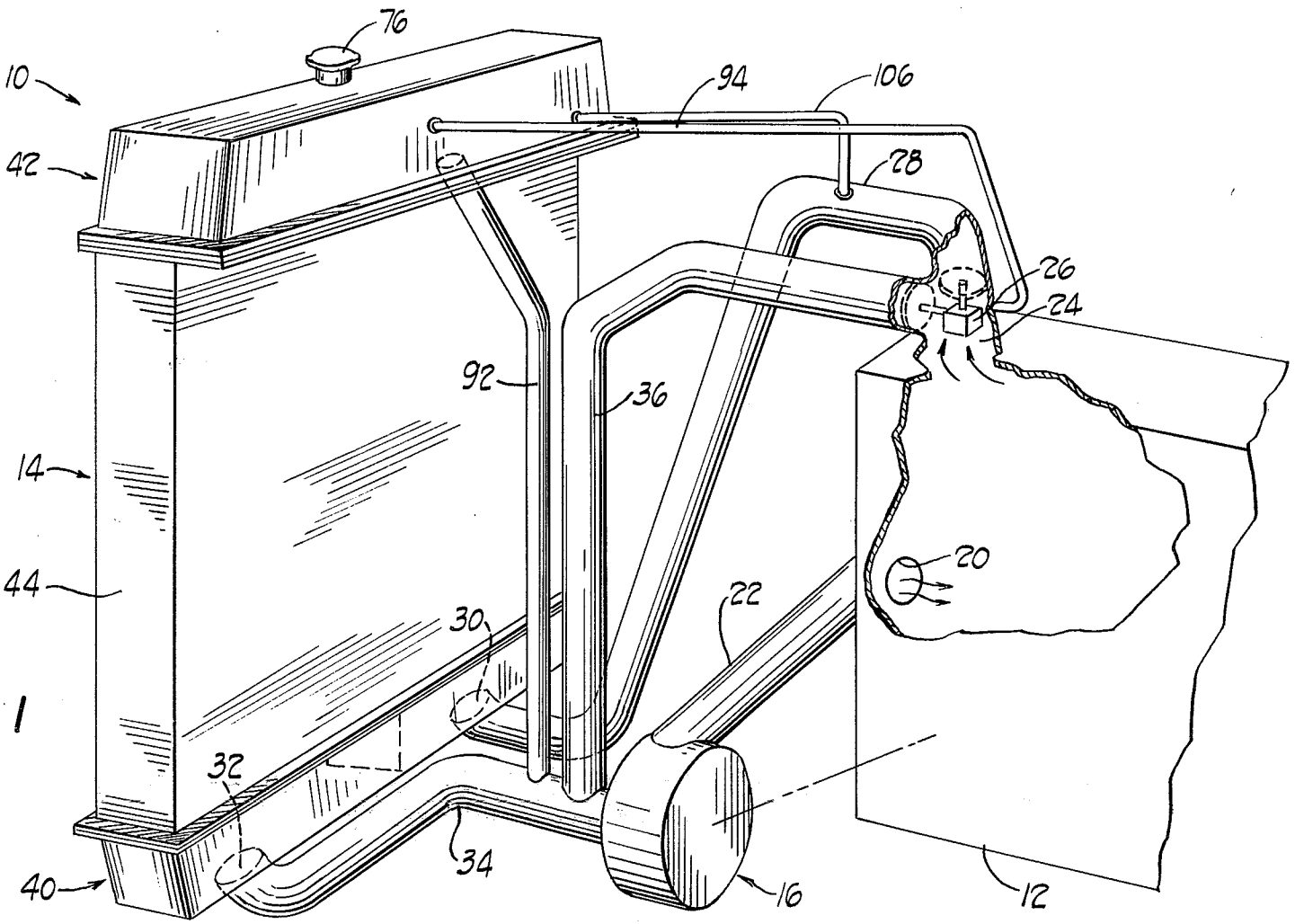
FIG. 1 is a schematic perspective view of an engine cooling system embodying the invention with portions broken away.

An engine cooling system 10 embodying the present invention is illustrated in FIG. 1. The system 10 comprises an engine block schematically indicated at 12 defining internal cooling passages through which engine coolant flows to carry the heat generated by the engine from the block. Coolant which has carried heat away from the engine block passes through a radiator assembly 14 which functions to dissipate the heat from the coolant to atmospheric air. The atmospheric air is directed across heat transfer surfaces of the radiator assembly by an engine driven fan which is not shown.

The coolant enters the block 12 through a block coolant inlet 20 which communicates with the pump 16 through a pump discharge line 22. After the coolant has flowed through the engine coolant passages it is exhausted from the block 12 through a block coolant outlet 24. In the illustrated embodiment of the invention, the coolant outlet 24 is formed by a housing of a thermostatic valve 26 which functions, when the engine has warmed up and the coolant approaches its operating temperature, to direct coolant from the outlet 24 through a coolant conduit 28 to a radiator coolant inlet 30. Coolant which has passed through the radiator assembly 14 flows from a radiator coolant outlet 32 through a conduit 34 to the inlet of the pump 16.

When the engine 12 is cold the low temperature coolant causes the thermostatic valve 26 to block the coolant outlet 24 and force the coolant flowing from the engine to flow directly to the inlet of the pump 16 through a radiator bypass conduit 36. The coolant continues to bypass the radiator until the coolant in the system reaches a desired operating temperature. The valve 26 is then actuated to close the bypass conduit 36 and open the conduit 28 so that the engine coolant is directed through the radiator assembly.

The engine cooling system 10 is particularly well adapted for use with an engine coolant consisting of a mixture of water and ethylene glycol which is used year around. Operators of most vehicles employing ethylene glycol-water engine coolants run mixtures consisting of about 50% water and 50% ethylene glycol and approximately such a mixture is assumed in the following description.

Figure 2:
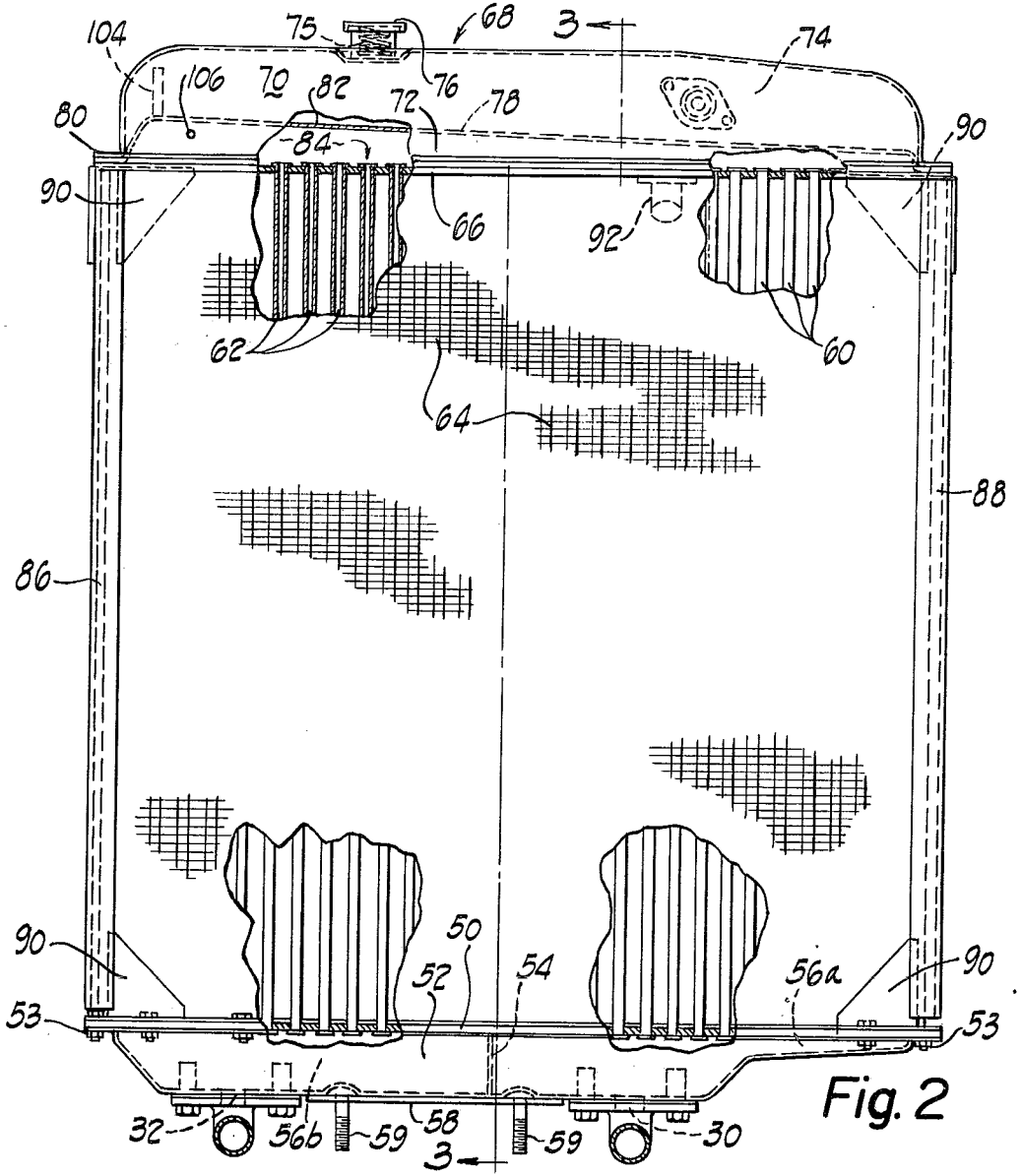
FIG. 2 is a front elevational view of a radiator constructed according to the invention with portions shown in cross section.

The radiator assembly 14 comprises a bottom tank structure 40, a top tank structure 42 and a radiator core assembly 44 extending between the top and bottom tanks. The preferred radiator assembly is constructed and arranged such that the coolant traverses the core assembly twice in passing through the radiator assembly and thus the radiator assembly 14 may be termed a "two pass" radiator. Referring now to FIG. 2, the bottom tank structure 40 comprises a generally planar base plate 50 and a cup-like cover plate 52 which is connected to the base plate 50 by a peripheral flange portion 53 which extends around the cover plate 52. A fluid tight partition 54 extends between the base plate 50 and the cover plate 52 about midway along the length of the bottom tank so that separate header chambers 56*a*, 56*b* are formed between the cover and base plate on either side of the partition 54.

The radiator assembly 14 is connected to a vehicle frame member, not shown, by a support plate 58 fixed to the cover plate 52 and studs 59 which extend downwardly from the support plate 58 for connection to the vehicle frame member.

Substantially all of the heat transferred from the coolant in the radiator assembly 14 to ambient air is extracted from the coolant as it passes through the radiator core assembly 44. The core assembly 44 comprises a first group of thin-walled core tubes 60 which are composed of a thermally conductive material and sealingly connected to the base plate 50. The core tubes 60 extend from the plate 50 to the top tank structure 42. The core tubes 60 open into the header chamber 56*a* and into the top tank structure 42 so that coolant flowing into the header chamber 56*a* through the radiator coolant inlet 30 traverses the core assembly once as it passes through the core tubes 60 to the top tank structure 42.

Coolant traverses the core assembly a second time via a second group of thin walled core tubes 62 which extend between the top and bottom tank structures and communicate the coolant which has flowed to the top tank structure through the core tubes 60 to the header chamber 56*b* of the bottom tank structure from which the coolant is directed from the radiator via the radiator coolant outlet 32. The groups of tubes forming the core assembly are supported and interconnected by heat transfer fins generally designated at 64 as is conventional.

Figure 4:
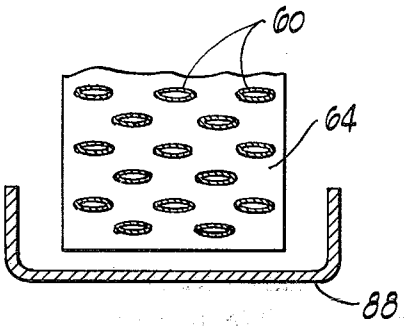
FIG. 4 is a view seen approximately from the plane indicated by the line 4—4 of FIG. 3.

The core tubes 60, 62 are all preferably of generally rectangular cross sectional shape with the long sides of the rectangles extending in the direction of air flow through the radiator. The leading and trailing sides of the tubes are radiused (see FIG. 4) to streamline the flow of air across the exterior of the tubes. Such core tubes provide large heat transfer areas. Furthermore, core tubes having this cross sectional shape tend to produce a fully turbulent flow of ethylene glycol-water coolant when Reynolds numbers are about 5000.

The number and size (i.e. the coolant flow area) of the core tubes of each group of tubes is determined primarily according to the capacity of the water pump 16. As noted previously the illustrated radiator assembly 14 is a two pass radiator in that the coolant traverses the core assembly twice as it flows through the radiator. It has been determined that in a standard ¾ inch core tube (having nominal internal length and width dimensions of 0.728 inches and 0.076 inches, respectively); a 50—50 mixture of water and ethylene glycol at 200°F, flowing at a rate of about 0.6 gallons per minute produces a Reynolds number of about 5000 in the tube. A standard ½ inch core tube handling 0.45 gallons per minute will result in a Reynolds in excess of 5000.

The number of tubes in each heat transfer pass can be determined by dividing the gallons per minute of coolant discharge from the coolant pump when the engine is operating at the low end of its normal operating speed range, by 0.6 gallons per minute per tube. This will provide a radiator construction in which the Reynolds number of the coolant flowing in the tube is at least 5000 during normal operation of the engine so that the coolant flow is always turbulent, and in which the number of tubes per pass is maximized so that the coolant tube heat transfer areas are maximum. The low end of the normal operating speed range of the engine is known as the torque peak speed of the engine and the engine operates at or above this speed during normal operation except when idling. The torque peak speed may vary from engine to engine but is generally around 1500 rpm.

The number of heat transfer passes required can be determined empirically, although it should be pointed out that because of the markedly greater heat transfer characteristics of tubes in which Reynolds numbers are at 5000 or greater, a given engine can be more effectively cooled by a two pass turbulent flow radiator than a single pass nonturbulent flow radiator having the same number of core tubes and using the same coolant pump.

The top tank structure 42 comprises a base plate 66 to which the groups of core tubes 60, 62 are connected at their upper ends and a cup-like cover 68 which is inverted over the base plate. The cover 68 comprises an upwardly extending body section 70 and a peripheral flange 72 which is sealingly connected to the base plate 66 around its periphery. The base plate and cover defines a reservoir or fill tank 74 between them which is accessible via a fill spout 75 and pressure cap 76 associated with the cover 68.

A baffle plate 78 extends between the base plate 66 and cover 68 along the length of the top tank. The baffle plate comprises a peripheral flange 80 which coextends with and is sealingly connected to the peripheral flange 72 of the cover and the base plate 66. The baffle plate 78 includes a body portion 82 which extends upwardly away from the base plate 66 to define a header chamber 84 extending over the upper ends of the core tubes 60, 62 so that the coolant flowing through the core tubes 60 passes through the header chamber 84 and is fractioned off from the chamber by the core tubes 62.

The radiator assembly 14 includes rigidifying structure (FIGS. 2–4) comprising channel shaped stiffeners 86, 88 which extend along opposite sides of the core assembly between the top and bottom tank structures and gussets, generally indicated at 90, which cooperate with the stiffeners to further stiffen the radiator assembly.

Figure 3:
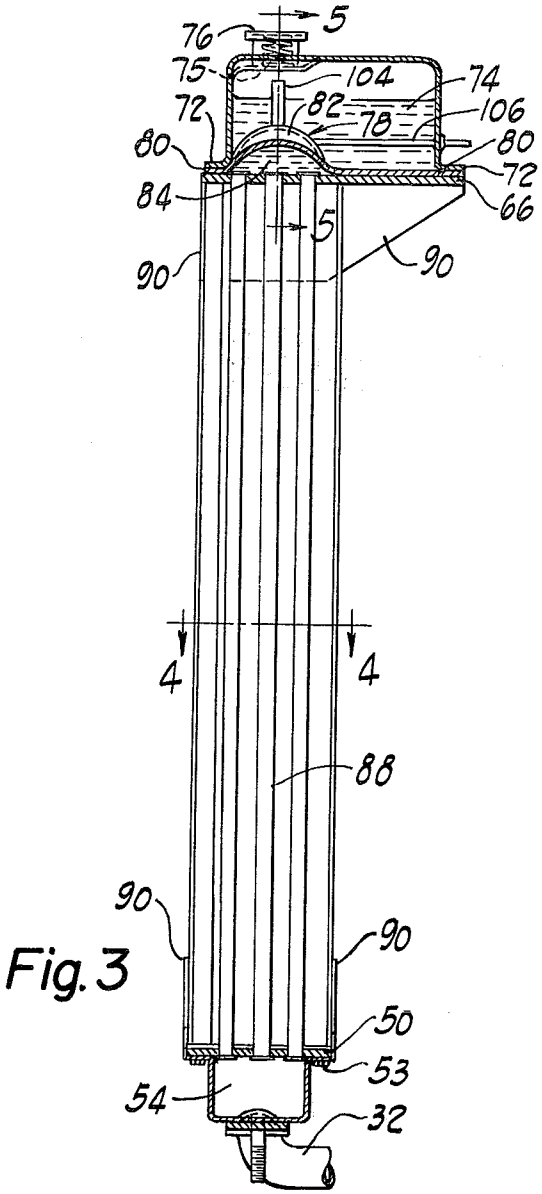
FIG. 3 is a view seen approximately from the plane indicated by the line 3—3 of FIG. 2.

As is best seen in FIG. 3 the top tank structure extends rearwardly from the core assembly 44 with the base plate 66 forming a horizontally extending bottom wall of the reservoir tank 74. A static pressure conduit 92 (FIGS. 1 and 2) opens into the reservoir through an opening in the rearwardly extending portion of the base plate 66 and extends to the pump inlet conduit 34. The conduit 92 functions to establish a positive pressure at the intake of the pump 16 by virtue of the column of liquid supported in the conduit 92 and the reservoir tank 74 over the inlet conduit 34. The existence of this static pressure at the pump inlet assures against cavitation in the pump particularly when the pump is operated under conditions of high engine speed and high coolant temperature.

Deaeration of the coolant flowing from the engine block 12 is accomplished by an engine deaeration tube 94 which extends from the housing for the thermostatic valve 26 into the head space of the reservoir tank 74.

Detrained gas or air from the coolant tends to accumulate adjacent the thermostatic valve particularly when the engine has not been operated for a time. When the engine is started the air or gas is forced through the tube 94 and into the reservoir tank 74.

When the engine has been operating for a time, the tendency of air or gas in the circulating coolants to settle from the coolant in the vicinity of the thermostatic valve 26 is reduced and as a consequence the tube 94 tends to direct a stream of coolant, containing relatively small amounts of entrained air or gas, into the reservoir tank 74 due to the pressure drop across the thermostatic valve. The operation of the tube 94 of itself is not sufficient to adequately deaerate or degas coolant circulating in the system when the engine is operating, particularly when combustion gases are leaking into the coolant as frequently occurs.

Figure 5:
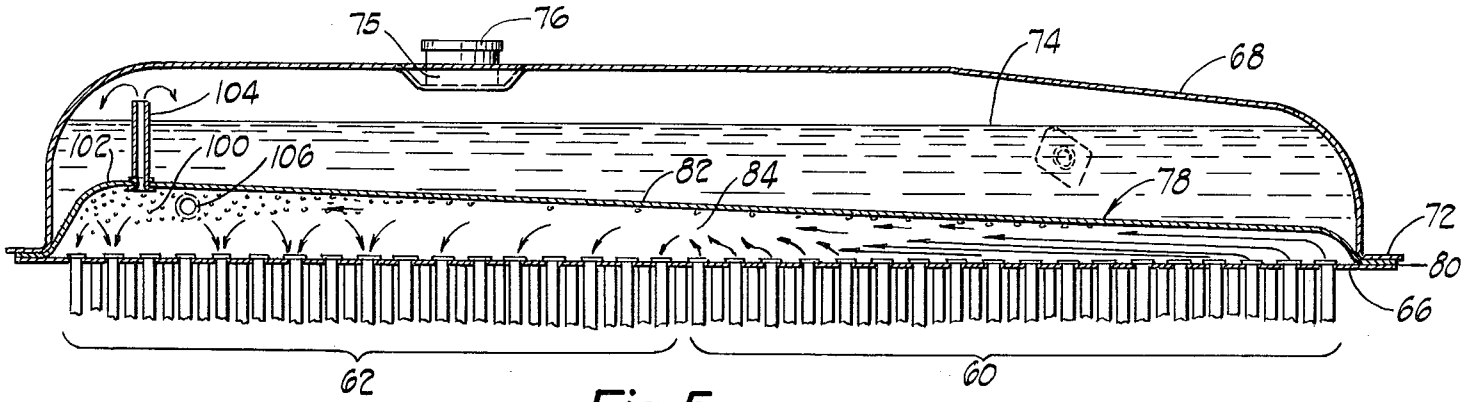
FIG. 5 is a cross sectional view seen approximately from the plane indicated by the line 5—5 of FIG. 3.

The radiator assembly 14 is constructed and arranged to positively deaerate or degas coolant flowing through it and is particularly effective in degassing ethylene glycol-water mixtures notwithstanding their relatively great film strengths which have the effect of resisting the removal of entrained gas or air from the coolant. As is shown in FIGS. 2, 3 & 5 the body 82 of the baffle plate 78 slopes upwardly proceeding along the upper ends of the groups of tubes 60, 62. The header chamber 84 thus provides a cross sectional flow area which increases proceeding along the upper ends of the core tubes 60 towards the core tubes 62. The flow area of the chamber 84 is of such size that coolant flowing into the chamber 84 is immediately decelerated as it passes into the chamber from the core tubes 60. The Reynolds number of the coolant flowing in the chamber 84 is reduced from at least 5000 to below 2100 and the coolant flow through the chamber 84 is thus at low velocity in the chamber 84 permits entrained gas to gravitate upwardly to the inclined upper wall of the baffle plate body where the gas bubbles are moved slowly along toward the end of the chamber 84 overlying the core tubes 62.

The chamber 84 defines a region of quiescent coolant in which the coolant flow virtually ceases the bubbles of detrained gas can accumulate. The flow area of the chamber 84 continuously increases proceeding along the core tubes 62. The tubes 62 successively fraction off coolant from the chamber and therefore the flow velocity in the chamber 84 is reduced substantially in the chamber portion overlying the ends of the tubes 62.

As is best seen in FIG. 5, the chamber flow area is maximum adjacent the core tubes 62 farthest from the core tubes 60 and defines a region 100 in which the coolant is substantially quiescent. Gas which has settled to the top wall portion of the chamber 84 gravitates towards the apex 102 of the baffle plate by virtue of the drift of the coolant through the chamber 84 and due to the upward inclination of the top wall of the chamber toward the apex 102.

Detrained air and gas which is directed to the apex of the baffle plate is communicated to the head space in the reservoir tank and thus for practical purposes is eliminated from the coolant system. In a preferred embodiment of the invention the air or gas is expelled from the chamber 84 via a vent tube 104 which is fixed to the baffle plate at its apex and extends from the baffle plate into the reservoir tank head space. The tube 104 is illustrated as a straight cylindrical member having its opposite ends opening into the chamber 84 and the head space, respectively. Due to the connection of the reservoir tank to the coolant pump inlet line by the static pressure conduit 92, a moderate pressure differential normally exists across the vent tube 104 which causes flow from the chamber 84 into the reservoir tank. The pressure differential thus expels air or gas detrained from the coolant in the chamber 84.

The pressure differential also causes the flow of some coolant into the reservoir tank from the chamber 84 which is accompanied by flow of the same quantity of coolant from the reservoir back into the coolant circuit via the conduit 92. Continuous accumulation of air and gas in the head space will raise the system pressure until part of the gas in the head space is vented via the radiator pressure cap.

Another important feature of the invention relates to a construction for venting the coolant system while it is being filled with coolant.

In the system illustrated in FIG. 1, and assuming that the system 10 is empty, coolant is introduced into the system through the fill spout 75 and the reservoir. The coolant flows through the static pressure conduit 92 to the conduit 34 from which the coolant fills the radiator 14 via the radiator outlet port 32 and the engine block is filled by coolant flowing from the conduit 34 through the pump 16 and the conduit 22.

When the engine block is being filled the air in the block is displaced to the vicinity of the thermostatic valve 26 which is located at the highest elevation of the coolant passages in the engine block. Because the coolant temperature is low the valve 26 blocks flow of the air into the conduit 28 and the air accumulated at the valve is vented to the coolant reservoir tank through the vent tube 94.

Coolant flowing into the radiator 14 fills the coolant tubes 62 from the bottom up, flows through the chamber 84 and downwardly through the tubes 60 into the conduit 28. The conduit 28 extends from the radiator bottom tank to the upper side of the thermostatic valve 26 and forms an inverted U-shaped section adjacent the thermostat.

In order to avoid accumulation of a substantial amount of air in the conduit 28, a vent tube 106 is provided which extends from the top of the U-shaped conduit section, through the rear wall of the reservoir tank and into the chamber 84 adjacent the apex 102. The air trapped in the conduit 28 is forced through the tube 106 and into the chamber 84. The air then moves into the airspace above the liquid level in the reservoir through the vent tube 104, from which the air is displaced from the system through the fill spout 75.

The connection of the tube 106 between the conduit 28 and the chamber 84 results, during operation of the engine, in the bypassing of a small quantity of coolant around the core tubes 60 and into the chamber 84. The quantity of bypassed coolant is small because the tube 106 has a small flow area and because the pressure differential across the tube is relatively small, i.e. about equal to the pressure drop across the radiator pass defined by the core tubes 60. The chamber 84 thus provides an optimum location for venting the conduit 28 during filling of the system since during operation of the engine a much smaller quantity coolant is bypassed partially around the radiator than would bypass the radiator entirely were the tube 106 connected into the reservoir tank.

Figure 6:
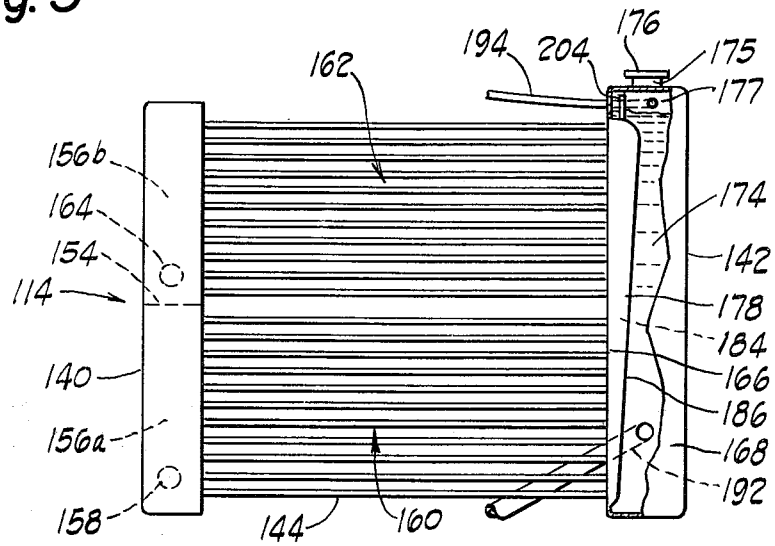
FIG. 6 is a schematic front elevational view of an alternate radiator construction embodying the invention with portions shown in cross section.

A modified radiator assembly 114, constructed in accordance with the invention, is schematically illustrated in FIG. 6. The radiator assembly 114 comprises spaced apart vertically extending side tank structures 140, 142, respectively, and a core assembly 144 extending horizontally between the side tank structures. The side tank structures and core assembly may be constructed substantially the same as the respective, corresponding top and bottom tanks 40, 42 and the core assembly 44 described in reference to FIGS. 1–5. The side tanks 140, 142 and core assembly 144 are therefore not described in greater detail than necessary to make their functions apparent.

The side tank 140 includes an internal partition 154 which divides the tank into separate vertically spaced header chambers 156*a*, 156*b*. Coolant enters the header chamber 156*a* from the engine through a radiator inlet opening 158. The coolant, flows from the chamber 156*a* to the tank 142 via a first group of radiator core tubes 160. Coolant is returned to the header chamber 156*b* from the tank 142 through a second group of core tubes 162. The coolant is returned to the engine through an outlet opening 164 in the header chamber 156*b*.

The side tank 142 comprises a base plate 166 and a cover plate 168 and defines a vertically extending reservoir or fill tank portion 174. A fill spout 175 extends from the upper end of the tank 142 so that coolant can be introduced into the cooling system. A pressure cap 176 closes the fill spout. A head space 177 extends above the coolant level in the reservoir 174 and in which air or gas removed from the coolant accumulates.

Like the radiator assembly of FIGS. 1–5, a static pressure conduit 192 extends from the reservoir tank 174 to the coolant pump inlet (not shown) and an engine deaeration tube 194 extends from the engine block (not shown) to the head space 177 in the tank 142.

The core tubes 160, 162 are fixed to the base plate 166 and open into the tank 142. The open ends of the tubes are in fluid communication so that the coolant which has passed through the tubes 160 flows from the tank 142 through the tubes 162. A baffle plate 178 extends vertically within the tank 142 and defines a header chamber 184 extending along the open ends of the core tubes 160, 162.

Like the radiator illustrated and described in connection with FIGS. 1–5 the velocity of coolant passing through the tubes 160, 162 is sufficiently large in the normal operating speed range of the engine, that the Reynolds number of the flowing coolant is 5000 or greater. The header chamber 184 is shaped to provide a maximum cross sectional flow area at the top end of the baffle plate and in the preferred embodiment of the invention the lateral side wall 186 of the baffle plate slopes away from the core tubes throughout its vertical extent. The cross sectional flow area of the chamber 184 at any given horizontal plane is greater than the total cross sectional flow area of the core tubes below the plane so that the velocity of the coolant flowing in the header chamber is maintained substantially less than the velocity of coolant in the core tubes. The velocity of coolant flowing upwardly in the header chamber preferably is sufficiently low that the Reynolds number is less than 2100, i.e. flow is laminar.

The chamber 184 defines a region of quiescent coolant at its upper end to which detrained gas bubbles migrate and can coalesce. The core tubes 162 fraction off coolant from the chamber 184 as it flows upwardly past the open ends of the tubes 162, and since the cross sectional area of the header chamber continues to increase proceeding along the ends of the core tubes 162, the flow velocity of the coolant in the chamber 184 steadily decreases until the coolant is virtually quiescent at the upper end of the header chamber.

Gas and/or air bubbles in the coolant gravitate to the top of the chamber 184 and are extracted from the coolant system. As shown in FIG. 6 a vent tube 204 extends from the top of the header chamber to the head space 177 in the reservoir 174. Because of a pressure differential existing between the chamber 184 and the reservoir tank, the detrained air and gas is forced through the vent tube into the head space 177 where it is accumulated and vented from the system periodically.

While only two embodiments of the invention are illustrated and described additional constructions embodying the invention should be apparent to those skilled in the art. For example, radiators having more than two heat transfer passes may be constructed merely by increasing the number of header chambers at the opposite ends of the core tubes. Deaeration can be effected by providing multiple variable area header chambers, each providing a quiescent region and a vent tube extending to the reservoir tank. Other adaptations, modifications and uses of the invention may occur to those skilled in the art and it is the intention to cover all such adaptations, modifications and uses which do not depart from the principles of the invention.

What is claimed is:

1. A method of cooling an internal combustion engine comprising:

a. circulating a coolant comprising a mixture of ethylene glycol and water through coolant passages in the engine by an engine driven pump;

b. communicating coolant exiting from the engine to a radiator header chamber via a radiator inlet;

c. passing the coolant through a plurality of first radiator coolant passages extending from said header chamber at velocities which establish a minimum Reynolds number of about 5000 at the torque peak speed of the engine;

d. exhausting coolant from projecting ends of said first radiator coolant passages into a second header chamber;

e. progressively reducing the coolant velocity as the coolant flows in said second header chamber;

f. establishing a region of substantially quiescent coolant in said second header chamber;

g. providing a coolant reservoir;

h. communicating said coolant reservoir with said substantially quiescent region;

i. detraining gas from the coolant in said substantially quiescent region and directing the detrained gas to said coolant reservoir;

j. fractioning off coolant from said second header chamber via a plurality of second radiator coolant passages opening into said second header chamber;

k. passing coolant through said second radiator coolant passages at velocities for establishing a minimum Reynolds number of about 5000 at the torque peak speed of the engine; and, l. exhausting coolant from said second radiator coolant passages into a third header chamber.

2. The method claimed in claim 1 further comprising establishing a pressure differential between said second header chamber and said coolant reservoir to force detrained gas from the second header chamber into said coolant reservoir.

3. The method claimed in claim 1 wherein passing coolant through said first and second pluralities or radiator coolant passages comprises directing the coolant in opposite generally vertical directions, respectively, and further including directing the coolant generally horizontally through said second header chamber.

4. The method claimed in claim 1 wherein passing coolant through said first and second pluralities of radiator coolant passages comprises directing the coolant generally horizontally in opposite directions through the respective pluralities of radiator coolant passages, and further including directing the coolant vertically upwardly in said second header chamber.

5. The method claimed in claim 1 further including positioning said reservoir above the elevation of the coolant pump intake and at least partly above the elevation of said second header chamber and wherein detraining gas from the coolant includes moving gas upwardly from said substantially quiescent region into said reservoir.

6. A method of deaerating and transferring heat from an internal combustion engine coolant comprising:

a. directing coolant through a plurality of first radiator core tubes at a velocity which insures turbulent flow of the coolant in the tubes;
b. transferring heat from the coolant flowing through said first core tubes;
c. directing coolant from the first core tubes into a header chamber communicating said first core tubes with a plurality of second core tubes;
d. reducing the velocity of coolant flowing in said header chamber from said first core tubes to said second core tubes to produce a region of substantially quiescent coolant in said header chamber;
e. deaerating the coolant by collecting gas from the coolant at a location in the header chamber adjacent said quiescent region;
f. venting gas from said location to a coolant reservoir;
g. fractioning coolant from said header chamber through said second core tubes;
h. flowing coolant through said second core tubes at a velocity which insures turbulent flow of the coolant through the second core tubes;
i. transferring heat from the coolant flowing through said second core tubes.

7. A method of cooling an engine utilizing a liquid coolant comprised of a substantial volume of ethylene glycol and an approximately equal volume of water comprising:

a. pumping the coolant through cooling passages in the engine;
b. directing the coolant from the engine to a radiator;
c. flowing the coolant through a header chamber in the radiator and into a first plurality of radiator core tubes;
d. directing the coolant through the first plurality of core tubes at a velocity which corresponds to a Reynolds number of at least 5000 and transferring heat from the coolant as it passes through the core tubes;
e. flowing the coolant discharged from the first plurality of core tubes through a second header chamber to a second plurality of core tubes;
f. reducing the velocity of coolant flowing in said second header chamber from said first plurality of core tubes;
g. establishing a region of minimum coolant flow velocity in said second header chamber;
h. directing gas entrained in said coolant to said region;
i. directing the coolant through the second plurality of core tubes from said second header chamber at a velocity corresponding to a Reynolds number of at least 5000 and transferring heat from the coolant as it flows through said second plurality of core tubes;
j. providing a coolant reservoir;
k. communicating said coolant reservoir with said region of minimum coolant flow; and,
l. moving gas from said region to said reservoir.

8. The method claimed in claim 7 wherein directing coolant through said first and second pluralities of core tubes comprises flowing the coolant through each tube at a flow rate of at least 0.45 gallons per minute.

* * * * *